US012790665B2

(12) United States Patent
Piefer et al.

(10) Patent No.: US 12,790,665 B2
(45) Date of Patent: Nov. 10, 2026

(54) SEPARATION OF RARE EARTH ELEMENTS IN AN ENVIRONMENT WITH LOW PARTIAL PRESSURES OF OXYGEN CONTAINING GASES

(71) Applicant: Shine Technologies, LLC, Janesville, WI (US)

(72) Inventors: Greg Piefer, Janesville, WI (US); Eric Van Abel, Janesville, WI (US); Charles Shackett, Janesville, WI (US); Thomas Drury, Janesville, WI (US); Richard Sisson, Janesville, WI (US)

(73) Assignee: SHINE Technologies, LLC, Janesville, WI (US)

( * ) Notice: Subject to any disclaimer, the term of this patent is extended or adjusted under 35 U.S.C. 154(b) by 0 days.

(21) Appl. No.: 19/109,306

(22) PCT Filed: Sep. 6, 2023

(86) PCT No.: PCT/US2023/032105
§ 371 (c)(1),
(2) Date: Mar. 6, 2025

(87) PCT Pub. No.: WO2024/054513
PCT Pub. Date: Mar. 14, 2024

(65) Prior Publication Data

US 2025/0257425 A1 Aug. 14, 2025

Related U.S. Application Data

(60) Provisional application No. 63/404,080, filed on Sep. 6, 2022.

(51) Int. Cl.
*C22B 59/00* (2006.01)

(52) U.S. Cl.
CPC ..... *C22B 59/00* (2013.01)

(58) Field of Classification Search
None
See application file for complete search history.

(56) References Cited

U.S. PATENT DOCUMENTS 3,558,440 A 1/1971 Harris et al.
5,437,709 A 8/1995 Ellis et al.
(Continued)

FOREIGN PATENT DOCUMENTS

CN 101307384 A 11/2008
CN 101835914 A 9/2010
(Continued)

OTHER PUBLICATIONS

English translation of RU-2704005-C1. (Year: 2019).*
(Continued)

*Primary Examiner* — Anthony J Zimmer
*Assistant Examiner* — Zachary John Baum
(74) *Attorney, Agent, or Firm* — Dinsmore & Shohl LLP

(57) ABSTRACT

A method for purifying lutetium that includes sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises water vapor, and the water vapor is present in the environment at a partial pressure of 1.5 torr or less during the sublimation/distillation period.

19 Claims, 2 Drawing Sheets

(56) References Cited

U.S. PATENT DOCUMENTS

| | | | |
|---|---|---|---|
| 6,716,353 | B1 | 4/2004 | Mirzadeh et al. |
| 6,878,183 | B2 | 4/2005 | Soeda et al. |
| 7,244,403 | B1 | 7/2007 | Maloney et al. |
| 8,668,785 | B2 | 3/2014 | Shindo et al. |
| 9,816,156 | B2 | 11/2017 | Marx et al. |
| 2007/0297554 | A1 | 12/2007 | Lavie et al. |
| 2010/0260640 | A1 | 10/2010 | Shindo et al. |

FOREIGN PATENT DOCUMENTS

| | | | |
|---|---|---|---|
| CN | 102230089 | A | 6/2011 |
| CN | 102719685 | A | 10/2012 |
| CN | 103718250 | A | 4/2014 |
| CN | 109082542 | A | 12/2018 |
| CN | 111440947 | A | 7/2020 |
| RU | 2542733 | C1 | 2/2015 |
| RU | 2704005 | C1 | 10/2019 |
| WO | 2019106182 | A1 | 6/2019 |
| WO | 2021102167 | A1 | 5/2021 |
| WO | 2021202914 | A1 | 10/2021 |

OTHER PUBLICATIONS

Danielson, P. Sources of water in vacuum systems. R&D Magazine, Sep. 2000, reprinted in Normandale Community College website, https://www.normandale.edu/academics/degrees-certificates/vacuum-and-thin-film-technology/articles/sources-of-water-vapor-in-vacuums-systems.html. Accessed Jun. 3, 2025. (Year: 2000).*

International Search Report and Written Opinion mailed Mar. 11, 2024, pertaining to Int'l Patent Application No. PCT/US2023/032105, 7 pgs.

Gupta et al. "Extractive Metallurgy of Rare Earths", 1-484. CRC Press. Web, Https://vector.umd.edu/images/links/Extractive_Metallurgy_of_Rare_Earths_Gupta.pdf. 2005; p. 22 paragraph 3, p. 28 paragraph 4, p. 29 paragraph 2, table 5.8.

National Library of France, Gallica. bnf.fr/ BnF. "Weekly Minutes of the Sessions of the Academie des sciences/published by the perpetual Secretaries" Session of Jun. 17, 1957.

Dash et al. Indirect Production of No Carrier Added (NCA) 177Lu from Irradiation of Enriched 176Yb: Options for Ytterbium/Lutetium Separation, Current Radiopharmaceuticals, vol. 8, No. 2, 2015. pp. 107-118.

B. J. Beaudry & F. H. Spedding: "The Gd—Yb and Lu—Yb phase systems", Metallurgical and Materials Transactions B, vol. 5.7, No. 7, Nov. 30, 1973 (Nov. 30, 1973), New York, pp. 1631-1636, XP009529139, ISSN: 1543-1916, DOI: 10.1007/BF02646335.

Gschneider "The Application of Vacuum Metallurgy in the Purification of Rare-Earth Metals" No. IS-1195; CONF-650617-3. Ames Lab., Iowa State Univ. of Science and Tech., 1965, https://www.osti.gov/servlets/purl/4578286.

Zhuxian Qiu, "Nonferrous Metallurgy for Higher Education", p. 341, Metallurgical Industry Press, published on May 31, 1988.

Wu, "Rare Earth Metallurgy", Central South University Press, Sep. 30, 2001, p. 291.

Zuzana Dvorakova, "Production and chemical processing of Lu for nuclear medicine at the Munich research reactor FRM-II" Institut fur Radiochemie der Technischen Universitat Munchen, dissertation submitted Aug. 13, 2007.

Watanabe et al. "Production of highly purified no-carrier-added 177Lu for radioimmunotherapy", J Radioanal Nucl Chem (2015) 303, pp. 935-940.

Third Party Observation Submitted in Application No. 21721690.2 dated Dec. 8, 2025 (57 pages with English translation).

Panteleev (RAP Conference Proceedings, vol. 4, pp. 18-22, DOI: 10.37392/RapProc.2019.05) Published Sep. 2019.

Lonov (Vacuum, Volumne 47, Nos. 6-8, pp. 679-883, DOI: 10:1016/0042-207X(96)00086-3) Published Jun. 1996.

Clifford et al. (Nuclear Instruments and Methods in Physics Research Section A; Accelerators, Spectrometers, Detectors and Associated Equipment, vol. 480, Issue 1, pp. 29-35, 10.1016/S0168-9002(01)02043-5) Published Mar. 11, 2002.

Beaudry and Gschneider (Handbook on the Physics and Chemistry of Rare Earths, North Holland Publishing, Amsterdam, 1978, pp. 173-232, Published 1978.

Gschneider (Preparation and Purification of Rare Earth Metals and Effect of Impurities on their Properties, Ames Laboratory and Department of Materials, Science and Engineering, Iowa State University, Ames, Iowa, Science and Technology of Rare Earth Materials, 1980, Academic Press, Inc., ISBN 02-12-675640-6; Published 1980.

Third Party Observation Submitted in Application No. 23836097.8 dated May 7, 2026 (32 pages with English translation).

Tarasov et al., "Production of No. Carrier Added Lutetium-177 by Irradiation of Enriched Ytterbium-176", (Current Radiopharmaceuticals), 2015, 8, pp. 95-106.

Dvorakova, (PHD Thesis Production and chemical processing of 177Lu for nuclear medicine at the Munich research reactor FRM-II, Technische Universitat Munchen, 2007. Publication date of Sep. 20, 2007.

Xiaowei et al. "Preparation of High Purity Rare Earth Metals of Samarium Ytterbium and Thulium", (Rare Metal Materials and Engineering, vol. 45, issue 11, 2016, 2793-2797, has a publication date of Nov. 2016.

Kuznetsov et al., "Production of Lutetium-177: Process Aspects", (Radiochemistry vol. 61, No. 4, 381-395), 2019.

Third Party Observation Submitted in Application No. 23863754.0 dated Feb. 5, 2026 (302 pages with English translation).

Wikipedia Webpage, "Atmosphere of Earth" (https://en.wikipedia.org/wiki/Atmosphere_of_Earth) as of Nov. 27, 2015.

Japanese Office Action dated Jan. 26, 2026 relating to JP Patent Application No. 2022-559979.

Non-Final Office Action dated Apr. 1, 2026, relating to U.S. Appl. No. 18/504,730, filed Nov. 8, 2023.

Daane et al. (Distillation of Rare-Earth Metals, Proceedings of the Second Conference on Rare Earth Research, pp. 175-184, vol. 1, Edited by Joseph F. Nachman and Charles E. Lundin, Gordon and Breach Science Publishers; hereafter TP4) has a publication date between Sep. 24-27, 1961.

M. Jerab and K. Sakurai (Hexagonal Growth of Ytterbium Nanoparticles by N2 Gas Deposition; WDS'09 Proceedings of Contributed Papers, Part 111, pp. 142-150, ISBN 978- 80-7378-103-3; hereafter TPS) has a publication date of 2009.

M. Jerab and K. Sakurai (X-Ray Analysis of Yb Ultra Thin Film: Comparison of Gas Deposition and Ordinary Vacuum Evaporation, Advances in X-Ray Chemical Analysis, Japan, 40, 2009; ISSN 0911-7806, pp. 291-298; hereafter TPG) has a publication date of 2009.

Kobisk (Review of Isotopes Target Program, Isotopes Development Center, October 1963-Dec. 1964; Oak Ridge National Laboratory, Oak Ridge, Tennessee, pp. 1-39; hereafter TPIO) has a publication date of Sep. 14, 1965.

Kobisk and Adair (Nuclear Instruments and Methods, 167, 1979, pp. 153-160; hereafter TPII) has a publication year of 1979.

Third Party Observation Submitted in Application No. 20890923.7 dated Feb. 5, 2026 (23 pages with English translation).

* cited by examiner

SEPARATION OF RARE EARTH ELEMENTS IN AN ENVIRONMENT WITH LOW PARTIAL PRESSURES OF OXYGEN CONTAINING GASES

CROSS-REFERENCE TO RELATED APPLICATIONS

This application is a national phase entry of PCT/US2023/032105 filed on Sep. 6, 2023, which claims the benefit of U.S. Provisional Application No. 63/404,080 filed on Sep. 6, 2022, which are incorporated herein by reference in their entirety.

TECHNOLOGY

The present disclosure is generally related to the separation of rare earth elements and their purification. More particularly, it is related to the isolation and purification of lutetium from an irradiation target that includes other rare earth metals, such as ytterbium.

BACKGROUND

Lutiteum-177 (Lu-177) is a radioisotope that is used in the treatment of neuro endocrine tumors, prostate, breast, renal, pancreatic, and other cancers. In the coming years, approximately 70,000 patients per year will need Lu-177 during their medical treatments.

Accordingly, a need exists for improved techniques of separating and purifying radioisotopes, such as Lu-177.

SUMMARY

According to a first aspect of the present disclosure, a method for purifying lutetium includes sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises water vapor, and the water vapor is present in the environment at a partial pressure of 1.5 torr or less during the sublimation/distillation period.

A second aspect includes the method of the first aspect, wherein the water vapor is at a partial pressure of 1.5 torr or less in the environment during at least a 50% of the sublimation/distillation period.

A third aspect includes the method of the first aspect or the second aspect, wherein the water vapor is at a partial pressure of 1.5 torr or less in the environment during at least 75% of the sublimation/distillation period.

A fourth aspect includes the method of any of the previous aspects, wherein the water vapor is at a partial pressure of 1.5 torr or less in the environment during at least 95% of the sublimation/distillation period.

A fifth aspect includes the method of any of the previous aspects, wherein the water vapor is at a partial pressure of 1.5 torr or less in the environment during the entirety of the sublimation/distillation period.

A sixth aspect includes the method of any of the previous aspects, wherein the water vapor is present in the environment at a partial pressure of 1 torr or less.

A seventh aspect includes the method of any of the previous aspects, wherein the water vapor is present in the environment at a partial pressure of 0.1 torr or less.

An eighth aspect includes the method of any of the previous aspects, wherein the environment comprises $O_2$ gas, and the $O_2$ gas is present in the environment at a partial pressure of 1 torr or less.

A ninth aspect includes the method of the eighth aspect, wherein the $O_2$ gas is present in the environment at a partial pressure of 0.1 torr or less.

A tenth aspect includes the method of the eighth aspect or the ninth aspect, wherein the $O_2$ gas is present in the environment at a partial pressure of 0.01 torr or less.

An eleventh aspect includes the method of any of the previous aspects, wherein the environment comprises $CO_2$ gas, and the $CO_2$ gas is present in the environment at a partial pressure of 1 torr or less.

A twelfth aspect includes the method of the eleventh aspect, wherein the $CO_2$ gas is present in the environment at a partial pressure of 0.1 torr or less.

A thirteenth aspect includes the method of the eleventh aspect or the twelfth aspect, wherein the $CO_2$ gas is present in the environment at a partial pressure of 0.01 torr or less.

A fourteenth aspect includes the method of any of the previous aspects, wherein the environment comprises $NO_2$ gas, and the $NO_2$ gas is present in the environment at a partial pressure of 1 torr or less.

A fifteenth aspect includes the method of the fourteenth aspect, wherein the $NO_2$ gas is present in the environment at a partial pressure of 0.1 torr or less.

A sixteenth aspect includes the method of the fourteenth aspect or the fifteenth aspect, wherein the $NO_2$ gas is present in the environment at a partial pressure of 0.01 torr or less.

A seventeenth aspect includes the method of any of the previous aspects, wherein the environment comprises CO gas, and the CO gas is present in the environment at a partial pressure of 1 torr or less.

An eighteenth aspect includes the method of the seventeenth aspect, wherein the CO gas is present in the environment at a partial pressure of 0.1 torr or less.

A nineteenth aspect includes the method of the seventeenth aspect or the eighteenth aspect, wherein the CO gas is present in the environment at a partial pressure of 0.01 torr or less.

A twentieth aspect includes the method of any of the previous aspects, wherein the solid composition is contained in a crucible of a sublimation/distillation system and sublimating or distilling ytterbium from the solid composition comprises heating the crucible such that the ytterbium sublimates, distills, or both sublimates and distills from the solid composition and collects on a collection surface of the sublimation/distillation system.

A twenty-first aspect includes the method of the twentieth aspect, wherein the sublimation/distillation system further comprises a residual gas analyzer configured to detect one or more gases present in the environment.

A twenty-second aspect includes the method of the twenty-first aspect, wherein the method further includes detecting $H_2$ gas with the residual gas analyzer while sublimating or distilling ytterbium from the solid composition and after detecting $H_2$ gas at a level at or below a threshold level, decreasing the temperature in the environment to 90° C. or less.

A twenty-third aspect includes the method of the twenty-second aspect, wherein the threshold level comprises 0.1 ppm $H_2$.

A twenty-fourth aspect includes the method of any of the previous aspects, further including collecting the ytterbium for reuse.

A twenty-fifth aspect includes the method of any of the previous aspects, wherein the environment comprises a reduced pressure environment comprising a reduced pressure in a range from $1\times10^{-8}$ torr to 700 torr.

A twenty-sixth aspect includes the method of any of the twenty-fifth aspect, wherein the reduced pressure is $1\times10^{-3}$ or less.

A twenty-seventh aspect includes the method of any of the previous aspects, wherein the temperature is in a range of from 450° C. to 1500° C.

A twenty-eighth aspect includes the method of any of the previous aspects, wherein the temperature is less than 700° C.

A twenty-ninth aspect includes the method of any of the previous aspects, further including subjecting the lutetium composition to chromatographic separation to further enrich the lutetium in the lutetium composition.

A thirtieth aspect includes the method of the twenty-ninth aspect, further including, dissolving the lutetium composition an acid to form a dissolved lutetium solution, adding a chelator to the dissolved lutetium solution and neutralizing with a base to form a chelated lutetium solution comprising both chelated lutetium and ytterbium, and subjecting the chelated lutetium solution to chromatographic separation, collecting a purified, chelated lutetium fraction, and de-chelating the lutetium to obtain purified lutetium.

A thirty-first aspect includes the method of the thirtieth aspect, wherein the purified, chelated lutetium fraction has a purity of lutetium higher than that of the lutetium in the dissolved lutetium solution.

A thirty-second aspect includes the method of the thirtieth aspect or the thirty-first aspect, wherein the de-chelating comprises contacting the purified, chelated lutetium fraction with an acid that is hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof.

According to a thirty-third aspect of the present disclosure, a method for purifying lutetium includes sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises one or more oxygen containing gases, and the one or more oxygen containing gases are present in the environment at a collective partial pressure of 10 torr or less during the sublimation/distillation period.

A thirty-fourth aspect includes the method of the thirty-third aspect, wherein the one or more oxygen containing gases comprise a collective partial pressure of 10 torr or less in the environment during at least 50% of the sublimation/distillation period.

A thirty-fifth aspect includes the method of the thirty-third aspect or the thirty-fourth, wherein the one or more oxygen containing gases comprise a collective partial pressure of 10 torr or less in the environment during at least 75% of the sublimation/distillation period.

A thirty-sixth aspect includes the method of any of the thirty-third through thirty-fifth aspects, wherein the one or more oxygen containing gases comprise a collective partial pressure of 10 torr or less in the environment during at least 95% of the sublimation/distillation period.

A thirty-seventh aspect includes the method of any of the thirty-third through thirty-sixth aspects, wherein the one or more oxygen containing gases comprise a collective partial pressure of 10 torr or less in the environment during the entirety of the sublimation/distillation period.

A thirty-eighth aspect includes the method of any of the thirty-third through thirty-seventh aspects, wherein the collective partial pressure of the one or more oxygen containing gases present in the environment is 0.01 torr or less.

A thirty-ninth aspect includes the method of any of the thirty-third through thirty-eighth aspects, wherein the collective partial pressure of the one or more oxygen containing gases present in the environment is 0.001 torr or less.

A fortieth aspect includes the method of any of the thirty-third through thirty-ninth aspects, wherein the one or more oxygen containing gases present in the environment comprise one or more of water vapor, $O_2$ gas, $CO_2$ gas, $NO_2$ gas, CO gas, a hydrocarbon gas, and alcohol gas.

A forty-first aspect includes the method of any of the thirty-third through fortieth aspects, wherein an overall pressure in the environment is 10 torr or greater during the sublimation/distillation period.

A forty-second aspect includes the method of any of the thirty-third through forty-first aspects, wherein the one or more oxygen containing gases are present in the environment at a collective partial pressure in a range of from 0.01 torr to 10 torr during the sublimation/distillation period.

According to a forty-third aspect of the present disclosure, a method for purifying lutetium includes sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises one or more oxygen containing gases, and the one or more oxygen containing gases are present in the environment at a collective partial pressure of 1 torr or less during the sublimation/distillation period, wherein one of the one or more oxygen containing gases comprises water vapor, and the water vapor is present in the environment at a partial pressure of 0.1 torr or less during the sublimation/distillation period, and wherein an overall pressure in the environment is 1 torr or greater during the sublimation/distillation period.

A forty-fourth aspect includes the method of the forty-third aspect, wherein the method further includes detecting $H_2$ gas in the environment with a residual gas analyzer while sublimating or distilling ytterbium from the solid composition and after detecting $H_2$ gas at a level at or below a threshold level, decreasing the temperature in the environment to 90° C. or less.

A forty-fifth aspect includes the method of the forty-third or the forty-fourth aspects, wherein the one or more oxygen containing gases are present in the environment at a collective partial pressure in a range of from 0.01 torr to 10 torr during the sublimation/distillation period.

A forty-sixth aspect includes the method of any of the previous aspects, wherein the solid composition is in a range of from 0.5 g to 10 g at a start of the sublimation/distillation period.

A forty-seventh aspect includes the method of any of the previous aspects, wherein the water vapor is present in the environment at a partial pressure of from 0.001 torr to 1.5 torr during the sublimation/distillation period.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Figure 1:
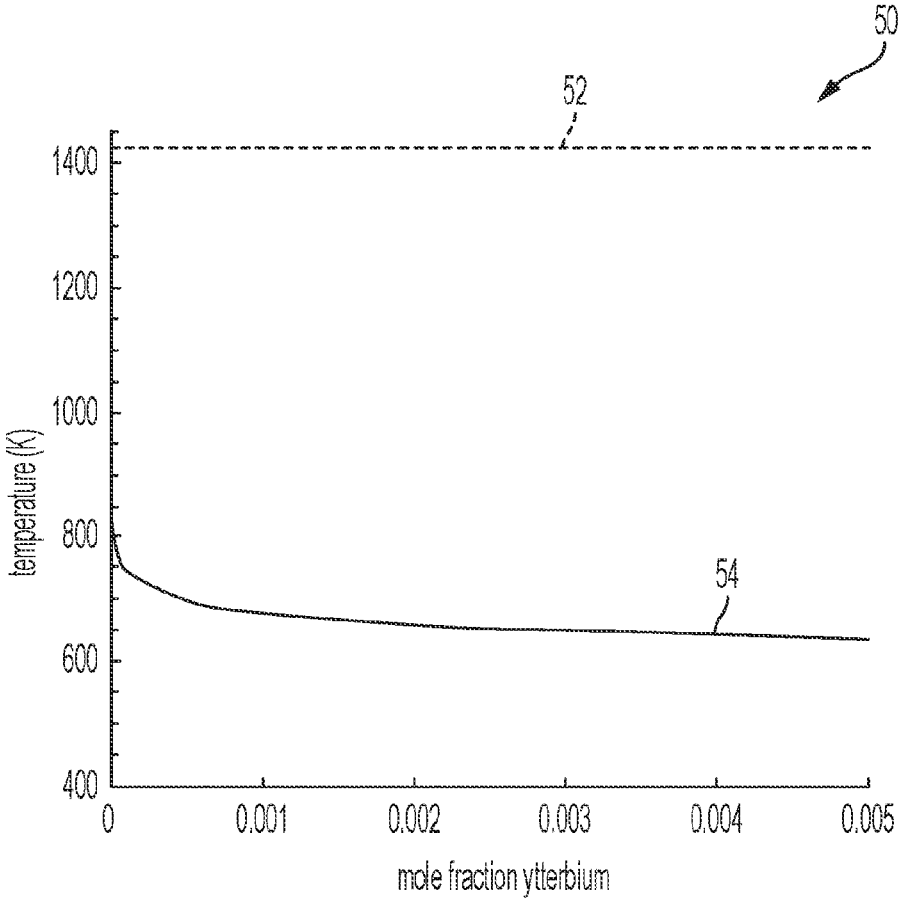
FIG. 1 is a T-x-y diagram for lutetium and ytterbium at a constant pressure of 1 μTorr.

Referring generally to the figures, embodiments of the present disclosure are directed to methods of separating rare earth elements using a sublimation or distillation process in a high temperature environment having low partial pressures of certain gases, such as oxygen containing gases that are reactive with rare earth elements. For example, embodiments of the present disclosure are directed to separating lutetium from a composition (e.g., a solid composition) comprising ytterbium and lutetium to obtain high purity lutetium, for example high purity isotopes of lutetium, such as Lu-177. Lu-177 is useful for many medical applications, because during decay it emits a low energy beta particle that is suitable for treating tumors. It also emits two gamma rays that can be used for diagnostic testing. Isotopes with both treatment and diagnostic characteristics are termed "theranostic." Not only is Lu-177 theranostic, but it also has a 6.65-day half-life, which allows for more complicated chemistries to be employed, as well as allowing for easy global distribution. Lu-177 also exhibits chemical properties that allow for binding to many bio molecules, for use in a wide variety of medical treatments.

There are two main production pathways to produce Lu-177. One is via a neutron capture reaction on Lu-176; Lu-176 (n,γ) Lu-177. This production method is referred to as carrier added (ca) Lu-177. A carrier is an isotope(s) of the same element (Lu-176 in this gas), or similar element, in the same chemical form as the isotope of interest. In microchemistry the chemical element or isotope of interest does not chemically behave as expected due to extremely low concentrations. Moreover, isotopes of the same element cannot be chemically separated, and require mass separation techniques. The carrier method, therefore, results in the produced Lu-177 having limited medical application.

The second production method for Lu-177 is a neutron capture reaction on ytterbium-176 (Yb-176) (Yb-176 (n,γ) Yb-177) to produce Yb-177. Yb-177 then rapidly ($t_{1/2}$ of 1.911 hours) beta-decays into Lu-177. An impurity of Yb-174 is typically present in the Yb-176, leading to a further impurity of Lu-175 in the final product. This process is considered a "no carrier added" process. The process may be carried out as ytterbium metal or ytterbium oxide.

The present disclosure describes a process for the separation of Yb and Lu obtained from a no carrier added process. The process includes a distillation/sublimation process to purify the lutetium and remove excess Yb after irradiation. The process may then also include further purification of the lutetium using a chromatographic separation process. Due to the limited amounts of material that may be processed at any one time during the chromatographic separation, the process of enriching the Lu prior to chromatographic separation allows for scaling of the recovery of the product Lu at a much greater level than previously obtainable. For example, the current process for chromatographic separation by itself is limited to 20 milligram targets per pass, with each pass taking 30 minutes to 1 hour of processing time. The combined distillation/sublimation and chromatographic separation allows for use of larger targets, and isolation of the product via distillation that can then be passed to the chromatographic process. Processing a 20-gram sample with chromatography alone would require 1000 batches, and significant loss of material.

The separation of Yb and Lu may, at least partially, take advantage of the difference in their vapor pressure at a particular temperature and pressure. As an example, the boiling point of Yb is 1196° C., while that of Lu is 3402° C. at standard temperature and pressure. The difference in vapor pressures at a specified temperature and pressure can be used to separate Yb and Lu via sublimation and/or distillation. Referring now to FIG. 1, graph 50 is a T-x-y diagram for lutetium and ytterbium at a constant pressure of 1 μTorr. In FIG. 1, line 54 represents the condensed phase composition at a given temperature (i.e., the bubble point), while line 52 represents the vapor phase (i.e., dew point). Graph 50 was prepared using the ideal gas and ideal solution assumptions, which are valid in view of the low pressure, high temperature, and chemical similarity of the two components.

In sublimation, the solid phase of an element is converted directly to the gas phase via heating, and the gas phase can then be collected for later use. In distillation, the solid is heated to its boiling point (going through the liquid phase) and vaporized off. The vaporized fraction can then be recovered downstream after the vapor is condensed. In this case, the ytterbium is vaporized (and it may be collected downstream for later use) leaving behind a material that is enriched in lutetium. This may be conducted on larger scale, therefore increasing the amount of lutetium available. It is noted that the Yb that is collected is available for recycling to the reactor to produce further Lu in subsequent runs of the process.

Figure 2:
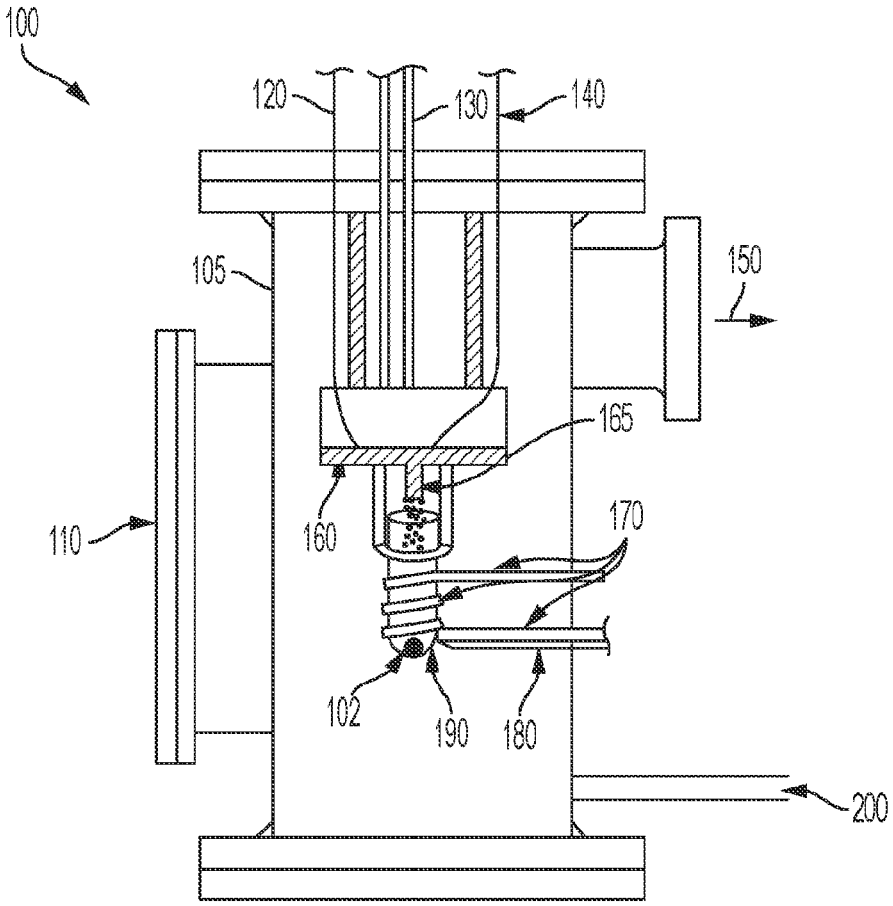
FIG. 2 schematically depicts a chamber for distillation/sublimation of the ytterbium and lutetium according to one or more embodiments shown and described herein.

Referring now to FIG. 2, a sublimation/distillation apparatus 100 for separating rare earth elements, such as lutetium and ytterbium, is schematically depicted. The sublimation/distillation apparatus 100 includes a chamber 105 with gas, cooling, vacuum, power, and instrument feedthroughs. The sublimation/distillation apparatus 100 can generate an environment in the chamber 105 having a variety of conditions, such as high temperatures, low pressures, high levels of inert gas, and low partial pressures of select gases. The sublimation/distillation apparatus 100 comprises a crucible 190 and a heating element 170, which may be housed together in the chamber 105. The chamber 105 may also include a sealable access port 110 that provides a user with selective access to the crucible 190, for example, to access and transfer a sample contained in the crucible 190. The crucible 190 may be made of a refractory material (e.g., molybdenum or tantalum). In some embodiments, the heating element 170 is an induction heating element, such as an RF induction coil. The crucible 190 may be suspended or supported within the RF induction heating coil. A temperature sensor 180 monitors the temperature of the crucible 190 and pressure sensing instrumentation 140 monitors the overall pressure of the chamber 105 and the partial pressures of one or more gases of interest, such as oxygen containing gases. In some embodiments, the pressure sensing instrumentation 140 includes a residual gas analyzer configured to detect one or more gases present in the environment, for example, the partial pressures of one or more gases present in the environment. The sublimation/distillation apparatus 100 also includes a vacuum pump connection 150 and at least one port 200 for inert gas introduction.

The sublimation/distillation apparatus 100 includes a collection surface 160, which forms a cold surface. The collection surface 160 may be actively cooled by cooling water lines 130. The temperature of the collection surface 160 may be monitored by a temperature sensor 120. In some embodiments, the collection surface 160 may also include a cold finger 165 (e.g., a cooling rod) that extends from the collection surface 160 toward the crucible 190 and is disposed directly above the crucible 190. The cold finger 165 and the collection surface 160 are capable of movement, which allows the open end of the crucible 190 to be open to the vacuum system (e.g., open to the chamber 105) or sealed against the collection surface 160. In some embodiments, the cold finger 165 includes an end effector. Indeed, the cold finger 165 may extend from the collection surface 160 toward the crucible 190 such that the cold finger 165 extends into the crucible 190 when the collection surface 160 is sealed onto the crucible 190. Like the collection surface 160, the cold finger 165 may also be actively cooled. In other embodiments, the collection surface 160 may be a surface (e.g., an inner surface) of a collection crucible. The collection crucible may be a second crucible having an open end that is oriented to face an open end of the crucible 190.

Referring still to FIG. 2, a method for separating and purifying lutetium from a composition (e.g., a solid composition 102) that includes lutetium and ytterbium will now be described. The method includes sublimating or distilling ytterbium from the solid composition 102 in an environment having low partial pressures of one or more oxygen containing gases, such as, $H_2O$ gas (i.e., water vapor), $O_2$ gas, $CO_2$ gas, CO gas, $NO_2$ gas, a hydrocarbon gas (including methane), and alcohol gas (including methanol, ethanol, and isopropyl alcohol), and at a temperature of from 400° C. to 2000° C. for a sublimation/distillation period to leave a lutetium composition comprising a higher weight percentage of lutetium than was present in the solid composition 102. Indeed, at the start of the separation process, the solid composition 102 is contained in the crucible 190 and sublimating or distilling ytterbium from the solid composition 102 comprises heating the crucible 190, for example, using the heating element 170, such that the ytterbium sublimates, distills, or both sublimates and distills from the solid composition 102 and collects on the collection surface 160, including, in some embodiments, on the cold finger 165 and in some embodiments, on an inner surface of a collection crucible. As noted, the ytterbium that is sublimated/distilled from the solid composition may be recycled as additional target material for irradiation and re-use in a subsequent separation process.

The sublimation/distillation process yields a sample ("the lutetium composition") that is enriched in lutetium as compared to the solid composition that enters the process. At the start of the sublimation/distillation process (e.g., at the start of the sublimation/distillation period), the solid composition may have a mass in a range of from 0.1 gram (g) to 15 g, such as from 0.5 g to 10 g, from 1 to 10 g, from 1 to 5 g, for 1 to 2 g, such as 0.1 g, 0.25 g, 0.5 g, 1 g, 1.5 g, 2 g, 2.5 g, 3 g, 3.5 g, 4 g, 5 g, 5.5 g, 6 g, 6.5 g, 7 g, 8 g, 9 g, 10 g, 11 g, 12 g, 13 g, 14 g, 15 g, any range having any two of these values as endpoints, or any value in a range having any two of these values as endpoints. The yields and purity may be measured in a number of ways. For example, in some embodiments, the process yields an ytterbium mass reduction of the solid composition from 1000:1 to 10,000:1. In other words, after the sublimation/distillation is completed, there is 1000 to 10,000 times less ytterbium in the sample than prior to the process (i.e., than was present in the solid composition). In the lutetium composition that is recovered (i.e., the contents in the crucible that is subjected to the acid dissolution), there may, in some embodiments, be from 1 wt % to 90 wt % of ytterbium relative to total remaining mass that will then be separated as described below in a chromatographic process. In other embodiments, the ytterbium that is collected from the sublimation/distillation is collected in an amount that is from 90 wt % to 99.999 wt % of the ytterbium present in the solid composition. The purification steps are also conducted to remove other trace metals and contaminants. For example, materials such as metals, metal oxides, or metal ions of K, Na, Ca, Fe, Al, Si, Ni, Cu, Pb, La, Ce, Lu (non-radioactive), Eu, Sn, Er, and Tm may be removed. Stated another way, a method includes subjecting a sample comprising Yb-176 and Lu-177 to sublimation, distillation, or a combination thereof to remove at least a portion of the Yb-176 from the sample and form a Lu-177-enriched sample.

It has been observed that a purification of greater than 1000:1 reduction (i.e. a 1000 times reduction in the amount of Yb present) in Yb may be achieved. This includes greater than approximately 3000:1, greater than 8000:1, greater than 10,000:1, up to and including approximately 40,000:1. However, higher reductions in Yb may be required to meet purity requirements for some pharmaceutical products. Accordingly, additional purification may be conducted prior to use in pharmaceutical applications. Such purification may be obtained through the use of chelators and/or chromatographic separation.

Moreover, and without intending to be limited by theory, reducing the relative amount of oxygen containing gas in the environment during the sublimation/distillation period reduces oxidation reactions between the solid composition and the oxygen containing gases. For example, ytterbium separated from the solid composition may react with water vapor to form $Yb_2O_3$ and $H_2$ gas, or $Yb(OH)_3$ and $H_2$ gas. By reducing oxidation, contaminates in the resultant separated lutetium and ytterbium may be minimized. Oxidation may lead to higher concentrations of ytterbium in the lutetium composition, which then requires more effort to purify the lutetium composition in subsequent separation steps, such as chromatographic separation. Ytterbium is highly reactive, and at the temperatures of sublimation or distillation, will readily react and consume oxygen species present in the environment, even reducing otherwise stable molecules or materials. As the solid composition generally comprises less than 0.1% lutetium, an increase in the oxidation of the ytterbium can lead to large contamination of the lutetium fraction in the lutetium composition. In addition, conversion of the ytterbium to other forms that are non-metallic prevents its reuse as a metal target for irradiation, necessitating further chemical conversion to return it to a metallic form and further losses.

However, it is difficult to completely purge the environment of oxygen containing gas. Indeed, in some embodiments, it is useful to have a small amount of water vapor or other oxygen containing gases present in the environment. The pressure sensing instrumentation 140 (e.g., the residual gas analyzer) of the sublimation/distillation apparatus 100 is configured to detect $H_2$ gas. Without intending to be limited by theory, $H_2$ gas is an offgas component of the sublimation process, formed by $H_2O$ reacting with the Yb metal component of the solid composition to form Yb oxide or Yb hydroxide and $H_2$ gas. The $H_2$ gas is detected by the pressure sensing instrumentation 140 (e.g., the residual gas analyzer) during the sublimation/distillation process and can be used to determine when separation of the lutetium and ytterbium from the solid composition is complete based on a drop in the $H_2$ detection signal. In some embodiments, the method includes detecting $H_2$ gas with the pressure sensing instrumentation 140 (e.g., the residual gas analyzer) while sublimating or distilling ytterbium from the solid composition. After detecting $H_2$ gas at a level at or below a threshold level, the temperature in the environment is reduced to a threshold temperature. Thus, the presence of oxygen containing gases, albeit at low levels, facilities greater control of the sublimation/distillation process. In some embodiments, the threshold temperature is 90° C. or less, for example 85° C. or less, 80° C. or less, 75° C. or less, 70° C. or less, 65° C. or less, 60° C. or less, 55° C. or less, 50° C. or less, or any value in a range having any two of these values as endpoints. Once the threshold temperature is reached, the separated lutetium and the separated ytterbium can be recovered for further processing (lutetium) or re-use (ytterbium). In some embodiments, the threshold level of $H_2$ gas is in a range of from 0.02 ppm to 0.5 ppm $H_2$, for example, 0.03 ppm, 0.04 ppm, 0.05 ppm, 0.06 ppm, 0.07 ppm, 0.08 ppm, 0.09 ppm, 0.1 ppm, 0.125 ppm, 0.15 ppm, 0.175 ppm, 0.2 ppm, 0.225 ppm, 0.25 ppm, 0.275 ppm, 0.3 ppm, 0.35 ppm, 0.4 ppm, 0.45 ppm, 0.5 ppm, any range having any two of these values as endpoints, or any value in a range having any two of these values as endpoints.

In some embodiments, water vapor is present in the environment and is present at a partial pressure of 10 torr or less during the sublimation/distillation period, for example, 5 torr or less, 2 torr or less, 1 torr or less, 0.75 torr or less, 0.5 torr or less, 0.25 or less, 0.1 torr or less, 0.075 torr or less, 0.05 torr or less, 0.025 torr or less, 0.02 torr or less, 0.01 torr or less, 0.0075 torr or less, 0.005 torr or less, 0.0025 torr or less, 0.002 torr or less, 0.001 torr or less, 0.00075 torr or less, 0.0005 torr or less, 0.00025 torr or less, 0002 torr or less, 0.0001 torr or less, or any range having any two of these values as endpoints, or any value in a range having any two of these values as endpoints. In other words, water vapor is present in the environment at a partial pressure in a range of from greater than 0 to 10 torr during the sublimation/distillation period, for example, from greater than 0 to 5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.1 torr from greater than 0 to 0.075 torr, from greater than 0 to 0.05 torr, from greater than 0 to 0.025 torr, from greater than 0 to 0.002 torr, from greater than 0 to 0.001 torr, from greater than 0 to 0.0075 torr, from greater than 0 to 0.005 torr, from greater than 0 to 0.0025 torr, from greater than 0 to 0.02 torr, from greater than 0 to 0.01 torr, from greater than 0 to 0.00075 torr, from greater than 0 to 0.0005 torr, from greater than 0 to 0.00025 torr, from greater than 0 to 0.0002 torr, from greater than 0 to 0.0001 torr, or any range having any two of these values as endpoints, or any value in a range having any two of these values as endpoints. Example ranges partial pressures of water vapor are contemplated with higher lower bounds include from 0.001 torr to 10 torr, 0.001 torr to 1.5 torr, 0.001 to 1 torr, 0.01 torr to 10 torr, 0.01 torr to 1.5 torr, 0.01 torr to 0.1 torr, or any range having any two of these values as endpoints, or any value in a range having any two of these values as endpoints.

Without intending to be limited by theory, increasing the size of the solid composition increases the amount water vapor that is tolerable in the environment. Indeed, without intending to be limited by theory, the partial pressure of water vapor may be increased linearly with the increase in mass of the solid composition while retaining substantially the same amount percentage of oxidation (assuming the chamber 105 in which each of these comparative sublimation/distillations occur has the same volume). As an example, in a chamber 105 comprising a volume of 1 cubic foot, about 5% of a 1 g solid composition will form Yb oxide or Yb hydroxide and $H_2$ gas due to oxidation in an environment having a partial pressure of water vapor of about 0.1 torr at the start of the sublimation/distillation period, while about 5% of a 10 g solid composition will form Yb oxide or Yb hydroxide and $H_2$ gas due to oxidation in an environment having a partial pressure of water vapor of about 1.1 torr at the start of the sublimation/distillation period. Moreover, while still not intending to be limited by theory, altering the volume of the chamber 105 alters the amount of water vapor that is tolerable in the environment, where it may be desirable to reduce the relative partial pressure of water vapor for a chamber 105 with an increased volume and it may be desirable to increase the relative partial pressure of oxygen for a chamber 105 with an reduced volume.

It is contemplated that water vapor is present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

In some embodiments, $O_2$ gas is present in the environment and is present at a partial pressure of 10 torr or less during the sublimation/distillation period, for example, 5 torr or less, 2 torr or less, 1 torr or less, 0.75 torr or less, 0.5 torr or less, 0.25 or less, 0.1 torr or less, 0.075 torr or less, 0.05 torr or less, 0.025 torr or less, 0.02 torr or less, 0.01 torr or less, 0.0075 torr or less, 0.005 torr or less, 0.0025 torr or less, 0.002 torr or less, 0 001 torr or less, 0.00075 torr or less, 0.0005 torr or less, 0.00025 torr or less, 0002 torr or less, 0.0001 torr or less, or any range having any two of these values as endpoints, or any value in a range having any two of these values as endpoints. In other words, $O_2$ gas is present in the environment at a partial pressure in a range of from greater than 0 to 10 torr during the sublimation/distillation period, for example, from greater than 0 to 5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.1 torr from greater than 0 to 0.075 torr, from greater than 0 to 0.05 torr, from greater than 0 to 0.025 torr, from greater than 0 to 0.002 torr, from greater than 0 to 0.001 torr, from greater than 0 to 0.0075 torr, from greater than 0 to 0.005 torr, from greater than 0 to 0.0025 torr, from greater than 0 to 0.02 torr, from greater than 0 to 0.01 torr, from greater than 0 to 0.00075 torr, from greater than 0 to 0.0005 torr, from greater than 0 to 0.00025 torr, from greater than 0 to 0.0002 torr, from greater than 0 to 0.0001 torr, or any range having any two of these values as endpoints, or any value in a range having any two of these values as endpoints. Example ranges partial pressures of $O_2$ gas are contemplated with higher lower bounds include from 0.001 torr to 10 torr, 0.001 torr to 1.5 torr, 0.001 to 1 torr, 0.01 torr to 10 torr, 0.01 torr to 1.5 torr, 0.01 torr to 0.1 torr, or any range having any two of these values as endpoints, or any value in a range having any two of these values as endpoints. Moreover, it is contemplated that O2 gas is present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

In some embodiments, $CO_2$ gas is present in the environment and is present at a partial pressure of 10 torr or less during the sublimation/distillation period, for example, 5 torr or less, 2 torr or less, 1 torr or less, 0.75 torr or less, 0.5 torr or less, 0.25 or less, 0.1 torr or less, 0.075 torr or less, 0.05 torr or less, 0.025 torr or less, 0.02 torr or less, 0.01 torr or less, 0.0075 torr or less, 0.005 torr or less, 0.0025 torr or less, 0.002 torr or less, 0.001 torr or less, 0.00075 torr or less, 0.0005 torr or less, 0.00025 torr or less, 0002 torr or less, 0.0001 torr or less, or any range having any two of these values as endpoints, or any value in a range having any two of these values as endpoints. In other words, $CO_2$ gas is present in the environment at a partial pressure in a range of from greater than 0 to 10 torr during the sublimation/distillation period, for example, from greater than 0 to 5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.1 torr from greater than 0 to 0.075 torr, from greater than 0 to 0.05 torr, from greater than 0 to 0.025 torr, from greater than 0 to 0.002 torr, from greater than 0 to 0.001 torr, from greater than 0 to 0.0075 torr, from greater than 0 to 0.005 torr, from greater than 0 to 0.0025 torr, from greater than 0 to 0.02 torr, from greater than 0 to 0.01 torr, from greater than 0 to 0.00075 torr, from greater than 0 to 0.0005 torr, from greater than 0 to 0.00025 torr, from greater than 0 to 0.0002 torr, from greater than 0 to 0.0001 torr, or any range having any two of these values as endpoints, or any value in a range having any two of these values as endpoints. Example ranges partial pressures of $CO_2$ gas are contemplated with higher lower bounds include from 0.001 torr to 10 torr, 0.001 torr to 1.5 torr, 0.001 to 1 torr, 0.01 torr to 10 torr, 0.01 torr to 1.5 torr, 0.01 torr to 0.1 torr, or any range having any two of these values as endpoints, or any value in a range having any two of these values as endpoints. Moreover, it is contemplated that $CO_2$ gas is present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

In some embodiments, $NO_2$ gas is present in the environment and is present at a partial pressure of 10 torr or less during the sublimation/distillation period, for example, 5 torr or less, 2 torr or less, 1 torr or less, 0.75 torr or less, 0.5 torr or less, 0.25 or less, 0.1 torr or less, 0.075 torr or less, 0.05 torr or less, 0.025 torr or less, 0.02 torr or less, 0.01 torr or less, 0.0075 torr or less, 0.005 torr or less, 0.0025 torr or less, 0.002 torr or less, 0.001 torr or less, 0.00075 torr or less, 0.0005 torr or less, 0.00025 torr or less, 0002 torr or less, 0.0001 torr or less, or any range having any two of these values as endpoints, or any value in a range having any two of these values as endpoints. In other words, $NO_2$ gas is present in the environment at a partial pressure in a range of from greater than 0 to 10 torr during the sublimation/distillation period, for example, from greater than 0 to 5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.1 torr from greater than 0 to 0.075 torr, from greater than 0 to 0.05 torr, from greater than 0 to 0.025 torr, from greater than 0 to 0.002 torr, from greater than 0 to 0.001 torr, from greater than 0 to 0.0075 torr, from greater than 0 to 0.005 torr, from greater than 0 to 0.0025 torr, from greater than 0 to 0.02 torr, from greater than 0 to 0.01 torr, from greater than 0 to 0.00075 torr, from greater than 0 to 0.0005 torr, from greater than 0 to 0.00025 torr, from greater than 0 to 0.0002 torr, from greater than 0 to 0.0001 torr, or any range having any two of these values as endpoints, or any value in a range having any two of these values as endpoints. Example ranges partial pressures of $NO_2$ gas are contemplated with higher lower bounds include from 0.001 torr to 10 torr, 0.001 torr to 1.5 torr, 0.001 to 1 torr, 0.01 torr to 10 torr, 0.01 torr to 1.5 torr, 0.01 torr to 0.1 torr, or any range having any two of these values as endpoints, or any value in a range having any two of these values as endpoints. Moreover, it is contemplated that $NO_2$ gas is present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

In some embodiments, CO gas is present in the environment and is present at a partial pressure of 10 torr or less during the sublimation/distillation period, for example, 5 torr or less, 2 torr or less, 1 torr or less, 0.75 torr or less, 0.5 torr or less, 0.25 or less, 0.1 torr or less, 0.075 torr or less, 0.05 torr or less, 0.025 torr or less, 0.02 torr or less, 0.01 torr or less, 0.0075 torr or less, 0.005 torr or less, 0.0025 torr or less, 0.002 torr or less, 0.001 torr or less, 0.00075 torr or less, 0.0005 torr or less, 0.00025 torr or less, 0002 torr or less, 0.0001 torr or less, or any range having any two of these values as endpoints, or any value in a range having any two of these values as endpoint. In other words, CO gas is present in the environment at a partial pressure in a range of from greater than 0 to 10 torr during the sublimation/distillation period, for example, from greater than 0 to 5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.1 torr from greater than 0 to 0.075 torr, from greater than 0 to 0.05 torr, from greater than 0 to 0.025 torr, from greater than 0 to 0.002 torr, from greater than 0 to 0.001 torr, from greater than 0 to 0.0075 torr, from greater than 0 to 0.005 torr, from greater than 0 to 0.0025 torr, from greater than 0 to 0.02 torr, from greater than 0 to 0.01 torr, from greater than 0 to 0.00075 torr, from greater than 0 to 0.0005 torr, from greater than 0 to 0.00025 torr, from greater than 0 to 0.0002 torr, from greater than 0 to 0.0001 torr, or any range having any two of these values as endpoints, or any value in a range having any two of these values as endpoints. Example ranges partial pressures of CO gas are contemplated with higher lower bounds include from 0.001 torr to 10 torr, 0.001 torr to 1.5 torr, 0.001 to 1 torr, 0.01 torr to 10 torr, 0.01 torr to 1.5 torr, 0.01 torr to 0.1 torr, or any range having any two of these values as endpoints, or any value in a range having any two of these values as endpoints. Moreover, it is contemplated that CO gas is present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

In some embodiments, the one or more oxygen-containing gases are present in the environment and the collective partial pressure (e.g., the summation of the partial pressures of all oxygen containing gases in the environment) is 50 torr or less during the sublimation/distillation period, for example, 40 torr or less, 30 torr or less, 25 torr or less, 15 torr or less, 10 torr or less, 7.5 torr or less, 5 torr or less, 2.5 torr or less, 2 torr or less, 1 torr or less, 0.75 torr or less, 0.5 torr or less, 0.25 torr or less, 0.2 torr or less, 0.1 torr or less, 0.075 torr or less, 0.05 torr or less, 0.025 torr or less, 0.02 torr or less, 0.01 torr or less, or any range having any two of these values as endpoints, or any value in a range having any two of these values as endpoints. In other words, the collective partial pressure of the one or more oxygen containing gases present in the environment is in a range of from greater than 0 to 50 torr during the sublimation/distillation period, for example, from greater than 0 to 40 torr, from greater than 0 to 30 torr, from greater than 0 to 25 torr, from greater than 0 to 15 torr, from greater than 0 to 10 torr, from greater than 0 to 7.5 torr, greater than 0 to 5 torr, from greater than 0 to 2.5 torr, from greater than 0 to 2 torr, from greater than 0 to 1 torr, from greater than 0 to 0.75 torr, from greater than 0 to 0.5 torr, from greater than 0 to 0.25 torr, from greater than 0 to 0.2 torr, from greater than 0 to 0.1 torr, from greater than 0 to 0.075 torr, from greater than 0 to 0.05 torr, from greater than 0 to 0.025 torr, from greater than 0 to 0.02 torr, from greater than 0 to 0.01 torr or any range having any two of these values as endpoints, or any value in a range having any two of these values as endpoints. Example ranges partial pressures of the or more oxygen-containing gases are contemplated with higher lower bounds include from 0.001 torr to 50 torr, 0.001 torr to 30 torr, 0.001 to 25 torr, 0.001 to 10 torr, 0.001 to 5 torr, 0.001 to 1 torr, 0.01 torr to 50 torr, 0.01 torr to 25 torr, 0.01 torr to 10 torr, 0.01 torr to 5 torr, 0.01 torr to 1 torr or any range having any two of these values as endpoints, or any value in a range having any two of these values as endpoints.

The one or more oxygen containing gases present in the environment comprise one or more of water vapor, $O_2$ gas, $CO_2$ gas, $NO_2$ gas, CO gas, a hydrocarbon gas (including methane), and alcohol gas (including methanol, ethanol, and isopropyl alcohol). Moreover, it is contemplated that the one or more oxygen-containing gases are present in any of the above ranges and values during at least 50% of the sublimation/distillation period, for example, at least 55% of the sublimation/distillation period, at least 60% of the sublimation/distillation period, at least 65% of the sublimation/distillation period, at least 70% of the sublimation/distillation period, at least 75% of the sublimation/distillation period, at least 80% of the sublimation/distillation period, at least 85% of the sublimation/distillation period, at least 90% of the sublimation/distillation period, at least 95% of the sublimation/distillation period, at least 96% of the sublimation/distillation period, at least 97% of the sublimation/distillation period, at least 98% of the sublimation/distillation period, at least 99% of the sublimation/distillation period, or during the entirety of the sublimation/distillation period.

As noted above, by minimizing the levels of oxygen containing gases in the environment, oxidation may be minimized during the sublimation/distillation process, allowing the overall pressure in the environment to be increased when compared to previous techniques of rare earth element sublimation/distillation. Higher overall pressures may allow for faster and more complete sublimation/distillation by improving heat transfer to the sublimating/distilling material, as more heated gas may contact the solid composition. For example, by limiting the level of oxygen containing gases is the environment, such as to 10 torr or less, 1 torr or less, or the any of the values and ranges contemplated above, the overall pressure in the environment may be increases to 1 torr or greater, 2 torr or greater 5 torr or greater, or 10 torr or greater, 25 torr or greater, 50 torr or greater, 100 torr or greater, 250 torr or greater, 500 torr or greater, 760 torr or greater, 1000 torr or greater, and 1520 torr or greater, while still minimizing oxidation, or any range having any two of these values as endpoints, or any value in a range having any two of these values as endpoints. Also, higher overall pressures may allow simpler and more cost-effective designs that can be done without pressure/vacuum vessels and costly high vacuum equipment. Higher overall pressures may allow for more efficient transport of the Yb in the gas phase to surfaces (e.g., collection surfaces) that are located outside of the line-of-sight of the heated surfaces, which allows for more convoluted flow paths, which is helpful in increasing lutetium yield and increasing separation ratios between ytterbium and lutetium. These increased overall pressures may be achieved by introducing a non-reactive gas into the chamber 105, such as argon, krypton, xenon, or neon and/or by introducing a gas that is reactive, but not reactive with ytterbium or lutetium and not oxygen-containing, such as hydrogen gas.

Referring still to FIGS. 1 and 2, the temperature for sublimation and/or distillation (e.g. the temperature in the environment) may be in a range of from 400° C. to 2000° C., for example, from 450° C. to 1500° C., from 450° C. to 1200° C., from 450° C. to 1000° C., from 400° C. to 1000° C., from 400° C. to 900° C., from 400° C. to 800° C., from 450° C. to 700° C., from 400° C. to less than 700° C., from 400° C. to 695° C., from 450° C. to 690° C., from 450° C. to 685° C., from 450° C. to 680° C., from 450° C. to 675° C., from 450° C. to 670° C., from 450° C. to 665° C., from 450° C. to 660° C., from 450° C. to 655° C., from 450° C. to 650° C., from 450° C. to 645° C., from 450° C. to 640° C., from 450° C. to 635° C., from 450° C. to 630° C., from 450° C. to 625° C., 470° C. to about 630° C., from 800° C. to 2000° C., from greater than 800° C. to 2000° C., from 1000° C. to 2000° C., from 1200° C. to 2000° C., from 1500° C. to 2000° C., or any range having any two of these values as endpoints. Indeed, the temperature for sublimation and/or distillation (e.g., the temperature in the environment) may be 400° C., 425° C., 450° C., 470° C., 475° C., 500° C., 525° C., 550° C., 575° C., 600° C., 625° C., 640° C., 650° C., 655° C., 660° C., 665° C., 670° C., 675° C., 680° C., 685° C., 690° C., 695° C., 698° C., 700° C., 725° C., 750° C., 775° C., 800° C., 850° C., 900° C., 950° C., 1000° C., 1100° C., 1200° C., 1300° C., 1400° C., 1500° C., 1600° C., 1700° C., 1800° C., 1900° C., 2000° C., any range having any two of these values as endpoints, or any value in a range having any two of these values as endpoints. Also, according to various embodiments, the pressure of the environment at any of the temperatures and temperature ranges described above may be in a range of from 2000 torr to $1\times10^{-8}$, from 1520 torr to $1\times10^{-8}$ torr, from 1000 torr to $1\times10^{-8}$ torr, from 760 torr to $1\times10^{-8}$ torr, from 700 torr to $1\times10^{-8}$ torr, from 500 torr to $1\times10^{-8}$ torr, from 250 torr to $1\times10^{-7}$ torr, from 100 torr to $1\times10^{-6}$ torr, from 1 torr to $1\times10^{-6}$ torr, from $1\times10^{-1}$ torr to $1\times10^{-6}$ torr, $1\times10^{-3}$ or less, $1\times10^{-5}$ torr or less, $1\times10^{-6}$ torr or less, from 2000 torr to $1\times10^{-1}$ torr, from 1520 torr to 1 torr, from 1000 torr to 1 torr, from 760 torr to 1 torr, from 760 torr to 250 torr, any range having any two of these values as endpoints, or any value in a range having any two of these values as endpoints.

The time period required for the sublimating and/or distilling steps (e.g., the sublimation/distillation period) may vary widely and is dependent upon the amount of material in the solid composition, the temperature, and the pressure. It may vary from 1 second to 1 week. In some embodiments, it is a rate of sublimation or distillation that is pertinent to the question of time. It may, in some embodiments, be at a rate of from 10 min/g to 100 min/g of solid composition, or from 20 min/g to 60 min/g of solid composition. In one embodiment, the rate may be 40 min/g of solid composition.

Referring again to FIGS. 1 and 2, generally, the process of the initial purification by distillation and/or sublimation proceeds as follows. An enriched Yb-176 metal target is packaged into a tube with sealable ends. For example, the tube may be a quartz tube and the tube may have a diameter in a range of from 0.5 cm to 2 cm, such as a 1 cm diameter. The tube is then sealed in an overpack (e.g. aluminum) suitable for irradiation and impervious to water or air ingress. The sealed overpack is irradiated, for example, by a reactor or other neutron source, for several hours to several days (dependent on flux and batch requirements) to generate Lu-177 within the Yb-176 target. The sealed overpack is then loaded into a processing hotcell or isolator. Within the hotcell or isolator, which may comprise an inert environment, the irradiated Yb metal target is removed and placed inside the crucible 190 and placed in a vacuum chamber of the sublimation/distillation apparatus 100, where the partial pressure of one or more oxygen containing gases is reduced. To reduce partial pressure of one or more oxygen containing gases, inert gases, such as He, $N_2$, and Ar, may be introduced to the environment, displacing oxygen containing gases. In addition, or in the alternative, the pressure in the environment may be reduced, reducing the partial pressures of all gases in the environment, including oxygen containing gases.

The crucible 190 is then heated using the heating element 170, for example, by radiofrequency (RF) induction, for example, to a first temperature. At the first temperature, the direct sublimation of Yb is indicated by a slight pressure rise within the vacuum chamber due to engineered leak paths for small amounts of Yb vapor. As the Yb metal sublimates from the heated crucible it is deposited onto the collection surface, which may be actively cooled for collection and re-use. Sublimation continues for 30 to 50 minutes per gram of starting material (e.g., approximately 40 minutes per gram of starting material), and completion of the process is identified by an abrupt drop in vacuum pressure from about $5\times10^{-6}$ torr to less than about $1\times10^{-6}$ torr, or, alternatively, identified by a drop in the $H_2$ signal to at or below the threshold level of $H_2$ gas.

As the sublimation advances or after sublimation is complete, the crucible 190 may be heated to a second temperature, which is higher than the first temperature. At this stage of the process, the generated lutetium or lutetium oxide, minute quantities of ytterbium or ytterbium oxide, and trace contaminants remain in the crucible 190. Once the crucible 190 cools to a threshold temperature, for example, to a threshold temperature of 90° C. or less, the contents of the crucible, including the lutetium, are then dissolved in an acid to remove them from the crucible and for transfer to a chromatographic separation apparatus. The crucible 190 may be cooled passively (e.g., by removing the application of heat by the heating element 170 and waiting a period of time for thermal conduction) or actively (e.g., using a flowing gas or liquid).

Any of the above lutetium compositions or lutetium-enriched samples, as described herein, may be subjected to chromatographic separation to further enrich the lutetium in the composition or sample. Such chromatographic separations may include column chromatography, plate chromatography, thin cell chromatography, or high-performance liquid chromatography. Illustrative processes for purification of lutetium may be as described in U.S. Pat. Nos. 7,244,403 and 9,816,156, both of which are incorporated herein by reference in their entirety. However, it should be understood that other chromatographic separation techniques may be used to further enrich the lutetium separated using the techniques described herein. In one aspect, a process may include dissolving in an acid the lutetium and ytterbium composition that remains in the crucible after sublimation and applying the resultant solution to a chromatographic column or plate. This may include plate chromatographic materials, chromatographic columns, HPLC chromatographic columns, ion exchange columns, and the like.

As an illustrative example, a solution of lutetium in dilute HCl may be prepared (i.e. 0.01-5 N HCl). This may be applied to a solution packed, or dry, ion exchange column, and the lutetium eluted with additional washes of dilute HCl. This is generally described by U.S. Pat. No. 7,244,403 as that the solution susceptible to treatment is generally a dilute solution of a strong acid, usually HCl. The bed of resin which may be in the form of a strong anion exchange resin in a column and the contacting occurs by flowing the solution through the column. In some embodiments, the resin is a strongly basic anion exchange resin which is about 8% cross linked. First, an HCl solution is flowed through the column to form an HCl-treated column, then flowing an NaCl solution through the HCl treated column to form an NaCl treated column, and then flowing sterile water through the NaCl-treated column. These preparative steps assist in eluting a sterile, nonpyrogenic product. The resin may then be dried prior to application of the lutetium solution. In some embodiments, the anion exchange resin is in a powdered form, generally having particles in the size of from 100 mesh to 200 mesh. To speed solution flow though the column, a sterile gas pressure may be applied to the head of the column. This can be carried out by injecting a sterile gas, preferably air, into an upper end of the column to push the solution of lutetium-177 through the column. The lutetium-177 recovered from such a process may be in a higher purity than prior to the column chromatography through the anion exchange column.

In another aspect, a process may include the use of a cation exchange resin for the purification of lutetium from a composition that also include ytterbium. As an illustrative example, and as generally described by U.S. Pat. No. 9,816,156, the method includes loading a first column packed with cation exchange material, with the Lu/Yb mixture is dissolved in a mineral acid, exchanging the protons of the cation exchange material for ammonium ions, thereby using an $NH_4Cl$ solution, and washing the cation exchange material of the first column with water. An outlet of the first column is linked with the inlet of a second column that is also packed with a cation exchange material. A gradient of water and a chelating agent is then applied to the column starting at 100% of $H_2O$ to 0.2 M of the chelating agent on the inlet of the first column, so as to elute the lutetium from the first and second column. Illustrative examples of chelators include, but are not limited to, α-hydroxyisobutyrate [HIBA], citric acid, citrate, butyric acid, butyrate, EDTA, EGTA and ammonium ions. The method may also include determining the radioactivity dose on the outlet of the second column in order to recognize the elution of Lu-177 compounds; and collecting a first Lu-177 eluate from the outlet of the second column in a vessel, followed by protonating the chelating agent so as to inactivate same for the complex formation with Lu-177. The method may also include loading a final column packed with a cation exchange material by continuously conveying the acidic lutetium eluate to the inlet of the final column, washing out the chelating agent with diluted mineral acid of a concentration lower than approximately 0.1 M, removing traces of other metal ions from the lutetium solution by washing the cation exchange material of the final column with mineral acid of various concentrations in a range of approximately 0.01 to 2.5 M; and eluting the Lu-177 ions from the final column by way of a highly concentrated mineral acid of approximately 1 M to 12 M. Finally, an eluent containing higher purity lutetium than what was applied to the columns may be collected, and the solvent and mineral acid removed by vaporization.

In a further aspect, a process may include dissolving the lutetium and ytterbium composition or lutetium-enriched sample in an acid to form a dissolved lutetium/ytterbium solution, adding a chelator to the dissolved lutetium/ytterbium solution and neutralizing with a base to form a chelated lutetium/ytterbium solution comprising both chelated lutetium and ytterbium, and subjecting the chelated solution to chromatographic separation, collecting a purified, chelated lutetium fraction, and de-chelating the lutetium to obtain purified lutetium. The purified, chelated lutetium fraction has a purity of lutetium higher than that of the lutetium in the dissolved lutetium/ytterbium solution. Using such a chromatographic process high levels of lutetium purity may be obtained. For example, the purified lutetium obtained after chromatographic separation and work-up may include Lu-177 that is greater than 99% pure on an isotopic basis. This includes Lu-177 that is greater than 99.9%, greater than 99.99%, greater than 99.999%, or greater than 99.9999% pure on an isotopic basis.

Generally, a ytterbium metal or metal oxide target is irradiated to form Lu-177. The target is then dissolved in an acid, a chelator is added, and the solution neutralized with a base to form a chelated metal, chromatographic separation is conducted, and the purified metal is then decomplexed/de-chelated from the chelator. However, due to the limits of chromatography, by starting with an impure source of lutetium (i.e. the irradiated ytterbium oxide target), the efficiency of the chromatography is low, with only small fractions of purified lutetium being obtained with each chromatographic cycle, even on a preparative scale. Using the purified lutetium after distillation/sublimation, as described above, provides a surprising benefit in producing higher purity rare earth metals, particularly lutetium, that are not obtainable by either distillation or chromatography alone, on a larger scale, and in a shorter period of time.

The initial dissolution in an acid of the lutetium may be conducted using hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof. A concentration of the acid may be from 0.01 M to 6 M and/or a concentration of the base is from 0.01 M to 6 M. This includes concentrations of from 1 M to 6 M and from 2 M to 6 M. The chelator is then added along with a base (e.g. lithium hydroxide, sodium hydroxide, potassium hydroxide, $NH_4OH$, or an alkylammonium hydroxide) to neutralize the acid an produce the chelated lutetium. The chelated $^{177}Lu$ does contain other impurities at this point. For example, it will contain Yb, and it may contain K, Na, Ca, Fe, Al, Si, Ni, Cu, Pb, La, Ce, Lu (other than Lu-177), Eu, Sn, Er, and Tm. HPLC is then conducted. The HPLC may be conducted on an appropriate column and eluted with an appropriate mobile phase, each of which may change under different method development scenarios. As one example, the column may be a cation exchange column, an anion exchange column, a reversed phase C18 column, and the like and the mobile phase may any that is determined to achieve separation.

For further purification, the chelated $^{177}Lu$ is then applied to a high-performance liquid chromatography (HPLC) system (reversed phase C18 column with 12-14 vol % methanol) from which chelated $^{177}Lu$ is then eluted at a higher purity then when it was applied to the column. Acidification with HCl of the chelated $^{177}Lu$ releases it from the chelator as the chloride salt.

The mobile phase may be aqueous- or organic solvent-based. Illustrative examples include, but are not limited to water, alcohols, alkanes, ethers, esters, acids, bases, and aromatics. In various embodiments, the mobile phase may include water, methanol/water, methanol/trifluoroacetic acid/water, and/or methanol mobile phase.

After purification via HPLC of the chelated lutetium, there is a de-chelating process that is conducted to obtain the purified lutetium as a lutetium solution and/or ionic material. In some embodiments, the de-chelating includes contacting the purified, chelated lutetium fraction with an acid that is hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof. A concentration of the acid may be from 0.01 M to 6 M and/or a concentration of the base is from 0.01 M to 6 M. This includes concentrations of from 1 M to 6 M and from 2 M to 6 M.

As discussed above, the process described herein may be used for the separation of lutetium and ytterbium. However, it may be used to separate any of the rare earth, and/or actinide metals where there is a difference in boiling/sublimation point followed by further purification using the chromatographic separations in the presence of the various chelators. In the above chelators, rare earth elements that may be chelated for purification include cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y). In some embodiments, the methods include the chromatographic separation of rare earth elements from a mixture of at least two metal ions, where at least one of them is Ce, Dy, Er, Eu, Gd, Ho, La, Lu, Nd, Pr, Pm, Sm, Sc, Tb, Tm, Yb or Y.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical values or idealized geometric forms provided. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, optical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method for purifying lutetium, the method comprising:

sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises water vapor, and the water vapor is present in the environment at a partial pressure of 1.5 torr or less during the sublimation/distillation period, wherein the solid composition is contained in a crucible of a sublimation/distillation system and sublimating or distilling ytterbium from the solid composition comprises heating the crucible such that the ytterbium sublimates, distills, or both sublimates and distills from the solid composition and collects on a collection surface of the sublimation/distillation system, and wherein the sublimation/distillation system further comprises a residual gas analyzer configured to detect one or more gases present in the environment.

2. The method of claim 1, wherein the water vapor is at a partial pressure of 1.5 torr or less in the environment during at least 95% of the sublimation/distillation period.

3. The method of claim 1, wherein the water vapor is present in the environment at a partial pressure of 0.1 torr or less during the sublimation/distillation period.

4. The method of claim 1, wherein the solid composition is in a range of from 0.5 g to 10 g at a start of the sublimation/distillation period.

5. The method of claim 1, wherein the water vapor is present in the environment at a partial pressure of from 0.001 torr to 1.5 torr during the sublimation/distillation period.

6. The method of claim 1, wherein the environment comprises one or more of the following:

$O_2$ gas, wherein the $O_2$ gas is present in the environment at a partial pressure of 1 torr or less during the sublimation/distillation period;

$CO_2$ gas, wherein the $CO_2$ gas is present in the environment at a partial pressure of 1 torr or less during the sublimation/distillation period;

$NO_2$ gas, wherein the $NO_2$ gas is present in the environment at a partial pressure of 1 torr or less during the sublimation/distillation period; and CO gas, wherein the CO gas is present in the environment at a partial pressure of 1 torr or less during the sublimation/distillation period.

7. The method of claim 1, wherein the method further comprises:

detecting $H_2$ gas with the residual gas analyzer while sublimating or distilling ytterbium from the solid composition; and after detecting $H_2$ gas at a level at or below a threshold level, decreasing the temperature in the environment to 90° C. or less.

8. The method of claim 7, wherein the threshold level comprises 0.1 ppm $H_2$.

9. A method for purifying lutetium, the method comprising:

sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises water vapor, and the water vapor is present in the environment at a partial pressure of from 0.001 torr to 1.5 torr during the sublimation/distillation period.

10. The method of claim 9, wherein the water vapor is at a partial pressure of from 0.001 torr to 1.5 torr in the environment during at least 95% of the sublimation/distillation period.

11. The method of claim 9, wherein the solid composition is in a range of from 0.5 g to 10 g at a start of the sublimation/distillation period.

12. The method of claim 9, wherein the environment comprises one or more of the following:

$O_2$ gas, wherein the $O_2$ gas is present in the environment at a partial pressure of 1 torr or less during the sublimation/distillation period;

$CO_2$ gas, wherein the $CO_2$ gas is present in the environment at a partial pressure of 1 torr or less during the sublimation/distillation period;

$NO_2$ gas, wherein the $NO_2$ gas is present in the environment at a partial pressure of 1 torr or less during the sublimation/distillation period; and CO gas, wherein the CO gas is present in the environment at a partial pressure of 1 torr or less during the sublimation/distillation period.

13. The method of claim 9, further comprising detecting one or more gases present in the environment using pressure sensing instrumentation.

14. A method for purifying lutetium, the method comprising:

sublimating or distilling ytterbium from a solid composition comprising ytterbium and lutetium in an environment at a temperature in a range of from 400° C. to 2000° C. for a sublimation/distillation period to leave a lutetium composition comprising a higher weight percentage of lutetium than was present in the solid composition, wherein the environment comprises water vapor, and the water vapor is present in the environment at a partial pressure of 1.5 torr or less during the sublimation/distillation period; and detecting one or more gases present in the environment using pressure sensing instrumentation, wherein the detecting the one or more gases present in the environment comprises detecting partial pressures of one or more target gases.

15. The method of claim 14, wherein the one or more target gases comprise $H_2$ gas, $H_2O$ gas, $O_2$ gas, $CO_2$ gas, CO gas, $NO_2$ gas, a hydrocarbon gas, an alcohol gas, or a combination thereof.

16. The method of claim 14, wherein the detecting the one or more gases present in the environment occurs while sublimating or distilling ytterbium from the solid composition.

17. The method of claim 14, wherein the method further comprises:

detecting $H_2$ gas with the pressure sensing instrumentation while sublimating or distilling ytterbium from the solid composition; and after detecting $H_2$ gas at a level at or below a threshold level, decreasing the temperature in the environment.

18. The method of claim 17, wherein the threshold level comprises 0.1 ppm $H_2$ and decreasing the temperature in the environment comprises decreasing the temperature in the environment to 90° C. or less.

19. The method of claim 14, wherein the pressure sensing apparatus comprises a residual gas analyzer.

* * * * *